United States Patent [19]

Brauner

[11] Patent Number: 4,720,015

[45] Date of Patent: Jan. 19, 1988

[54] MOISTURE-PROOF, LINERLESS CARTON WITH RECLOSABLE TOP MEMBRANE

[75] Inventor: Arne H. Brauner, Plymouth, Minn.

[73] Assignee: International Paper Company, Purchase, N.Y.

[21] Appl. No.: 857,658

[22] Filed: Apr. 30, 1986

[51] Int. Cl.[4] ..... B65D 51/22

[52] U.S. Cl. ..... 206/621; 206/620; 220/461; 229/43

[58] Field of Search ..... 229/43; 206/620, 621, 206/626; 220/408, 410, 450, 462, 418, 461; 383/63, 65

[56] References Cited

U.S. PATENT DOCUMENTS

| | | | |
|---|---|---|---|
| 1,279,589 | 3/1918 | Robson | 229/43 |
| 2,305,371 | 7/1942 | Yates | 229/14 |
| 2,520,467 | 11/1950 | Merralls | 150/3 |
| 2,536,529 | 1/1951 | Bergstein | 206/621 |
| 2,674,289 | 7/1954 | Silverman | 150/3 |
| 2,746,502 | 5/1956 | Graell | 150/3 |
| 2,795,364 | 3/1957 | Benzon-Petersen | 229/37 |
| 2,878,849 | 1/1959 | Lingenfelter et al. | 150/0.5 |
| 2,886,231 | 6/1959 | Benzon-Petersen | 229/14 |
| 3,172,443 | 11/1965 | Ausnit | 150/3 |
| 3,190,531 | 3/1965 | Holmstrom | 229/7 |
| 3,288,345 | 5/1966 | Dilot | 229/14 |
| 3,362,608 | 2/1968 | Dilot | 229/14 |
| 3,392,901 | 7/1968 | Krzyzanowski | 220/462 |
| 3,473,589 | 10/1969 | Gotz | 206/620 |
| 3,656,682 | 8/1972 | Giuliani | 229/37 R |
| 3,680,764 | 4/1972 | Young et al. | 229/17 R |
| 3,741,463 | 7/1973 | Young et al. | 229/17 R |
| 3,827,472 | 8/1974 | Uramoto | 206/621 |
| 4,139,119 | 9/1979 | McLaren | 220/418 |

FOREIGN PATENT DOCUMENTS

| | | | |
|---|---|---|---|
| 1026281 | 2/1978 | Canada | 206/621 |

*Primary Examiner*—Stephen Marcus
*Assistant Examiner*—Gary E. Elkins
*Attorney, Agent, or Firm*—Walt Thomas Zielinski

[57] ABSTRACT

A carton is provided with a moisture-proof membrane which is die cut from a web on-line for attachment to an open ended carton. The membrane includes attachment sections which are sealed to the carton opening, and upright sections which extend outwardly from the attachment sections and overlie the carton opening. The upright sections include a removable membrane strip which provides an opening for dispensing foodstuff from the carton, and interlocking tab and groove elements which provide a resealing feature.

6 Claims, 8 Drawing Figures

MOISTURE-PROOF, LINERLESS CARTON WITH RECLOSABLE TOP MEMBRANE

DESCRIPTION

1. Field of Invention

This invention generally relates to moisture-proof carton constructions and, more particularly, a carton including a moisture impervious membrane which is reclosable and methods for applying the membrane to cartons.

2. Background Art

In packaging granulated or pulverized food products and products having sifting characteristics, it has been customary in the food industry to employ cartons provided with pouch liners formed from moisture impervious papers, foils or plastics. Such pouch liners typically have ends which are fused by heat to form closure ridges or fins. Once opened, the carton is resealed by folding or rolling the open ends of the inner pouch.

In order to effect cost savings in material and production machinery, and extended product shelf life, the packaging industry has developed and marketed linerless cartons provided with thermoplastic moisture-proof coatings and moisture-proof barrier closures. This approach is exemplified by U.S. Pat. Nos. 2,795,364 and 2,886,321, both to B. Benzon-Petersen, which are directed to cartons having rectangular parallelepiped configurations and a closure formed hingedly attached and overlapping closure flaps. An airtight seal is obtained by attaching a sealing membrane to the flaps when they are oriented in an outward direction prior to their closure. However, this structure does not provide an airtight moisture barrier once the membrane seal is broken limiting the usefulness of the package.

An alternative carton arrangement is disclosed in U.S. Pat. No. 3,190,531 to Holmstrom, which shows a membrane sealing sheet attached to interior surfaces of carton closure flaps. In order to provide a resealing feature, the membrane is attached to one flap at areas which outline an inwardly oriented U-shaped arch, and a sidewall panel adjoining the flap is provided with crease lines which form a spout. The spout is provided by severing the sealed bottom end of the U-shaped arch to define an opening to the interior of the carton, see FIGS. 1–3. The container is resealed by folding the flap across the opening in the container and interlocking the closure flaps.

In another approach of the prior art, represented by U.S. Pat. No. 4,139,119 to McLaren, a paperboard carton is provided with upper and lower thermoplastic liners which are adhesively connected to interior surfaces of the bottom and top walls of the carton. The ends of each liner are sealed by application of heat to define a moisture-proof pouch in the carton. Once opened, the liner is resealed in a conventional manner by folding and rolling open ends of the pouch.

The present invention is directed to an improved linerless carton having a sealing membrane and resealing structure of uncomplex design and enhanced effectiveness over prior art pouches. It will be appreciated that linerless cartons provide cost savings in materials and manufacturing efficiencies over pouch arrangements, and that a reclosable moisture-proof carton will meet a need of the packaging art.

Accordingly, it is the broad object of the present invention to provide an improved moisture impervious carton of economical design which is resealable.

A more specific object of the invention is to provide a linerless carton incorporating a closure membrane which obtains an airtight moisture-proof seal improved over the prior art.

A still further object of the invention is to provide a method for attaching a closure membrane to cartons which effects manufacturing efficiencies and faster production line speeds.

DISCLOSURE OF THE INVENTION

In the present invention, these purposes, as well as others which will be apparent, are achieved generally by providing an open ended carton including a membrane liner which is attached to and sealed to the carton opening. The carton includes a body portion formed by an upright boundary wall having an interior surface, a top end peripheral edge which defines the carton opening, and a cover for closing the top end of the carton. The membrane liner includes first and second attachment sections which are secured to the interior carton surface, and first and second upright sections which respectively extend outwardly from the first and second attachment sections and terminate at aligned edges. A removable connecting membrane strip secures the terminal edges of the upright sections together to provide a moisture-proof closure of the carton and upon removal a membrane opening which communicates with the carton opening and interior. The membrane liner also includes interlocking tab and groove elements integrally attached to the upright sections which provide a resealing feature.

In a preferred embodiment of the invention, the carton has a generally parallelepiped configuration including front, rear, and side wall sections, and the cover includes front, rear, and side closure flaps which are hingedly attached to embossed score lines to the peripheral edge of the carton. In this preferred embodiment, the membrane liner is attached to the interior surfaces of the closure flaps, and the upright sections have a length approximately equal to that of the carton opening. The upright sections are also provided with a tear line including a starting notch which facilitates separation of the removable connecting membrane strip.

According to the method of the invention, the membrane liner is fed from a continuous web of indefinite length to an advancing carton line where individual membrane sections are severed and sealed to the carton closure flaps. The membrane web preferably includes two overlapping and coextensive layers which are integrally attached at a top edge. The web includes a continuous tear line which forms the removable membrane strip in individual membrane liners, and continuous interlocking tab and groove elements which provide a reclosable fastener feature in the liners. Prior to alignment with and attachment to the carton, the membrane web is die cut to separate individual liners and dimension the liner upright sections so that they are approximately the length of the carton opening. Following die cutting operations, overlapping layers of the severed web sections, which form the membrane attachment sections, are folded outwardly approximately ninety degrees to form a flat surface for attachment to interior surfaces of the carton closure flaps.

Other objects, features and advantages of the present invention will be apparent when the detailed description of the preferred embodiments of the invention are considered in conjunction with the drawings which should be construed in an illustrative and not limiting sense as follows:

BEST MODE OF CARRYING OUT THE INVENTION

Figures 1, 2:
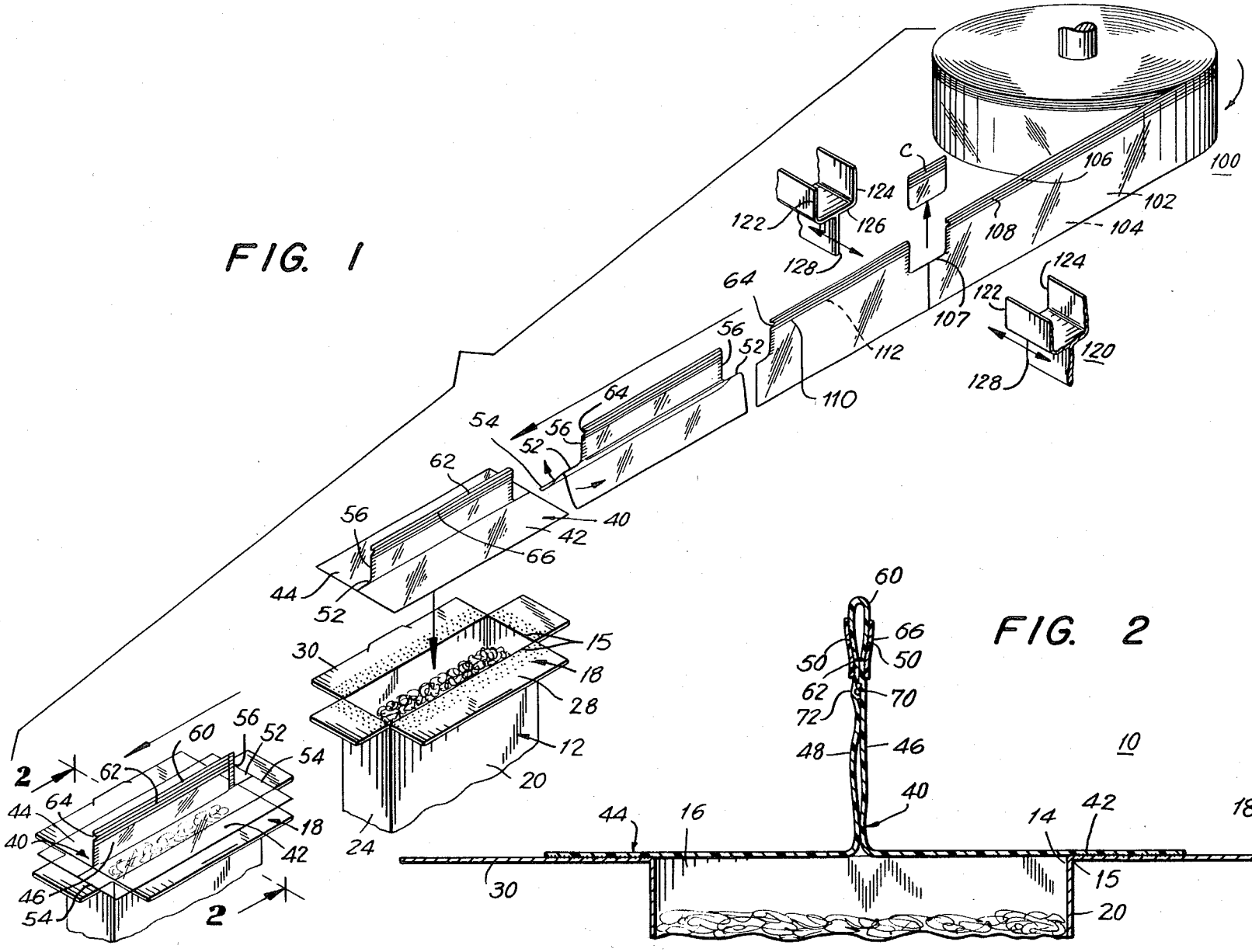
FIG. 1 shows a schematic view of the method of the invention according to which a continuous web of membrane liner material is advanced through a die cutting station to form individual membrane liners which are aligned with and attached to outwardly oriented closure flaps of a carton.
FIG. 2 is a vertical cross-sectional view of a carton including a membrane liner taken along the line 2—2 of FIG. 1.

Referring now to the drawings, a carton, generally designated 10, including a reclosable moisture-proof liner 40 is shown in FIG. 1 on a production line where a web of barrier material 100 is die cut, aligned and attached to an open top end of the carton. The method of the invention will be described in further detail following a discussion of the carton construction.

The carton 10 which is preferably fabricated of a laminated conventional folding carton paperboard, includes a body portion formed by an upright boundary wall 12, a top end peripheral edge 14 which defines a carton opening 16, and a cover 18 for closing the top end of the carton. In the preferred embodiment, the boundary wall has a generally parallelepiped configuration including front 20, rear 22, side 24, and bottom 26 wall sections, and the cover 18 includes front 28, rear 30 and side 32 closure flaps which are hingedly attached to the peripheral edge 14 of the carton at embossed score lines 15.

According to the invention, a moisture-proof closure of the carton is obtained by employment of the membrane liner 40 which may be fabricated of a moisture-proof plastic or foil having specifications conventionally known in the art. The membrane liner 40 includes first and second attachment sections 42, 44 which are secured to interior surfaces of the closure flaps 28, 30, 32 by conventional heat sealing processes, and first and second upright sections 46, 48 which respectively extend outwardly from the first and second attachment sections and terminate at aligned edges 50, see FIG. 2.

Figure 6:
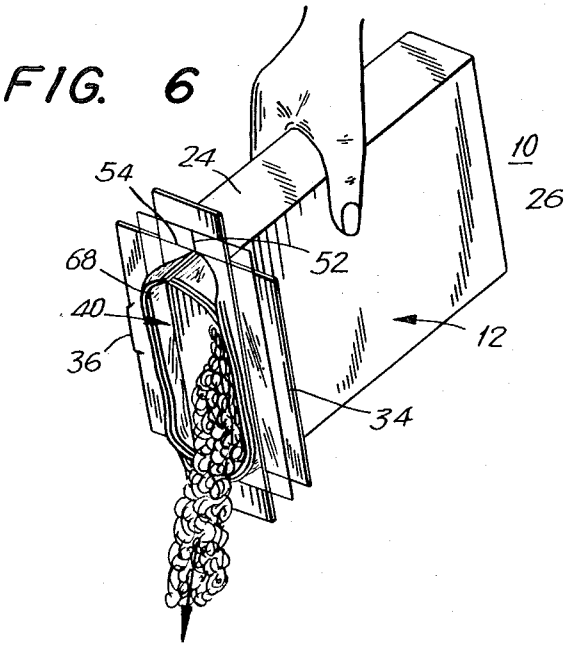

A removable connecting strip 60 secures the terminal edges 50 of the upright sections together to provide a moisture-proof closure of the carton. A tear line 62 which includes a starting notch 64 extends across the upright sections 46, 48 to define the removable strip 60. Tear line 62 is positioned in alignment with the orientation of the membrane material, so that it is "weakened" and readily severed by a tearing action. Separation of the membrane strip at tear line 62 is further facilitated by a fibrous tape 66 which is adhesively secured to the upright sections along the tear line. A membrane opening 68 to the interior of the carton is provided by removal of the membrane strip 60. See FIG. 6.

In order to provide an airtight closure membrane, attachment sections 42, 44 are joined by heat sealing techniques at longitudinal fold lines 52 which extend from the juncture of the attachment and upright sections to outer liner eges 54. Upright sections 46, 48 are sealed at opposing lateral side edges 56 which extend from fold lines 52 through membrane strip 60.

A reclosable feature of the invention is provided by interlocking tab and groove elements 70, 72, best shown in FIG. 2, which are integrally attached to the upright sections 46, 48 of the membrane liner. By way of example, sealable locking elements 70, 72 my be of the type commercially offered by Mini-Grip Corporation, Route 303, Orangeburg, N.Y. 10962, under the product trademark MINI-GRIP. MINI-GRIP reclosable liners effect an airtight seal which is particularly advantageous in maintaining the freshness of foodstuffs after removal of the membrane strip 60. It will be recognized that employment of the reclosable membrane liner of the present invention is a departure from prior art liners which failed to provide an airtight resealing feature, see for example U.S. Pat. No. 2,886,231 to Benzon-Petersen.

Figure 4:
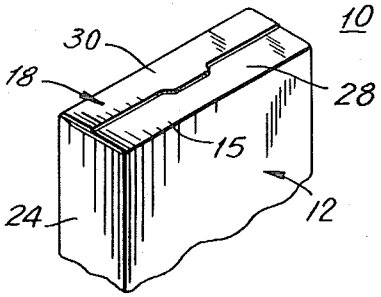
FIG. 4 shows the closure flaps secured together to provide a carton cover.
Figure 3:
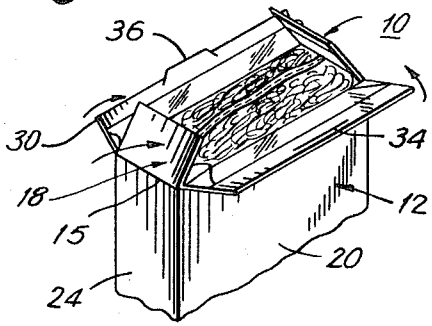
FIG. 3 shows the manner in which the carton closure flaps with attached membrane liner are folded inwardly to overlie and provide a cover for the carton.

FIGS. 3 and 4 illustrate the manner in which closure flaps 28, 30, 32 are folded inwardly with the attached membrane liner 40 to form a cover for the carton. The closure flaps may be adhesively attached for shipping and product display and provided with a conventional slot and tab 34, 36 arrangement for fastening the closure flaps together.

Figure 8:
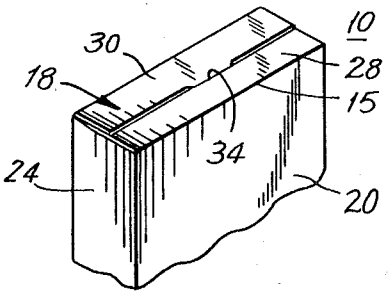
FIGS. 7 and 8 illustrate a resealing feature in the membrane liner including interlocking tab and groove elements.
Figure 5:
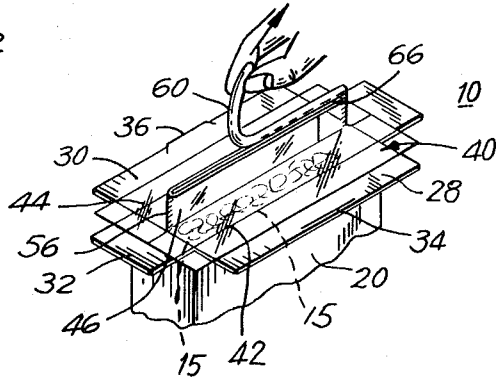
FIGS. 5 and 6 illustrate the manner in which a removable connecting membrane strip is separated at a tear line from upright sections in the membrane liner to provide an opening which communicates with the interior of the carton.
Figure 7:
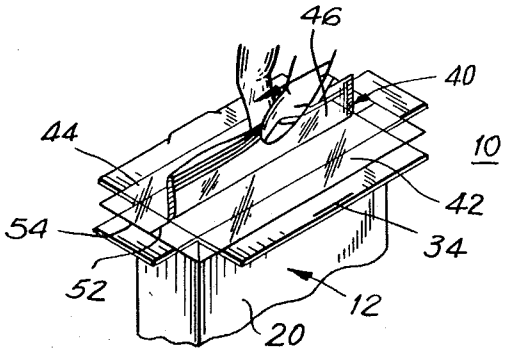

The manner in which the membrane liner 40 functions is illustrated in FIGS. 5–8. First, the closure flaps are opened, and the removable membrane strip 60 is severed from the liner at the tear line 62, as shown in FIG. 5. The reclosable MINI-GRIP fastener is then opened to provide access to the packaged foodstuff through membrane opening 68. An airtight reclosure of the carton is readily obtained by closure of the MINI-GRIP connecting elements 70, 72 and folding the closure flaps of the carton inwardly as illustrated in FIGS. 7–8.

On-Line Method of Applying Membrane Liner

According to the method of the invention, the membrane liner 40 is fed from a continuous web of indefinite length, designated 100 in FIG. 1, to an advancing carton line where individual membrane liners 40 are severed and applied to the carton closure flaps. Conventional heat fusing and sealing processes may be employed for this purpose. The membrane web 100 preferably includes two overlapping and coextensive layers 102, 104 which are integrally attached at a top edge 106. The web includes a continuous tear line 108 which forms the removable strip 60 in individual membrane liners. The web is also provided with continuous interlocking tab and groove elements 110, 112 which provide the reclosable fastener in the membrane liner 40. A web of suitable liner material is commercially offered by Mini-Grip Corporation under their MINI-GRIP brand name. Liner materials may be fabricated of paper/plastic, foil/plastic or paper/foil/plastic materials which are air impermeable.

Die cutting operations in accordance with the invention are schematically illustrated in FIG. 1. Attention is directed to the die cutting apparatus, designated 120, which includes lateral cutting edges 122, 124, 128 and horizontal cutting edge 126 which effect spaced lateral cuts in the web 100 to provide the individual membrane liners. Lateral and horizontal cutting edges 122, 124, 126 sever cutouts C in adjoining membrane liners extending from the top edge 106 to locations 107 spaced from the bottom of the web to define the relative dimensions of the attachment and upright sections 42–48 of the liner. Cutout scrap material is discarded during the cutting operations.

To provide an airtight attachment of the membrane liner 40 to the carton, the perimeter of the cutout area including lateral side edges 56 of the upright sections 46, 48 and longitudinal outwardly extending fold lines 52 in the attachment sections 42, 44 are heat sealed by conventional processes. Lateral liner edges of the attachment sections 54 are not sealed by cutting edges 128. Following die cutting operations, overlapping layers of attachment sections 42, 44 are folded outwardly approximately ninety degrees to form a flat surface to facilitate alignment and sealing of the liners 40 to cartons on-line. Efficiencies in production are furthered by filling the cartons with foodstuffs and orienting the closure flaps outwardly for alignment with the attachment sections.

From the foregoing, it will be appreciated that the present invention provides a moisture-proof reclosable carton which achieves the objects stated heretofore. In particular, a carton 10 is provided which includes a moisture impervious membrane liner 40 which obtains an airtight reclosable moisture-proof seal. Advantageously, the membrane liner includes an integral removable membrane strip 60 which is readily severed at a "weakened" tear line 62 as well as a reclosable tab and groove seal. Following removal of the membrane strip 60, upright sections 46, 48 in the liner provide an opening 68 approximately equal in dimension to that of the carton opening 16 for dispensing of foodstuff. The tab and groove members provide a reclosure feature which maintains product freshness.

According to the method of the invention, the membrane liner 40 is fed from a continuous web 100 of material including tear line 108 and tab and groove detail 110, 112 which, following die cutting operations, is readily attached to closure flaps of conventional cartons in-line. Simplicity in the design and required die cutting operations permit efficient on-line attachment of the liners to cartons at faster rates than obtained in the prior art.

Numerous modifications are possible in light of the above disclosure. For example, the drawings show a carton having a generally parallelepiped configuration. It will be appreciated that other carton configurations are within the scope of the disclosure. Similarly, although the preferred embodiment employs a web 100 of indefinite length and a die cutting operation to form the membrane liners 40, individual pre-cut liners may be utilized.

Therefore, although the invention has been described with reference to certain preferred embodiments, it will be appreciated that other carton constructions may be devised, which are nevertheless within the scope and spirit of the invention as defined by the claims appended hereto.

I claim:

1. A carton having an interior surface which comprises: an open ended body portion formed by an upright boundary wall, and a top end peripheral edge which defines the carton opening; a cover for closing the top end of the carton; and a membrane liner attached and sealed to the carton opening, said liner including first and second attachment sections which are secured to the interior carton surface, and first and second upright sections which respectively extend outwardly from the first and second attachment sections and terminate at aligned edges, said upright sections being integral parts of the respective attachment sections, said upright sections being secured together at the terminal edges by a removable connecting strip, said terminal edges, when the strip is removed, defining a membrane opening which communicates with the carton opening, said upright sections also including an integral means for resealing said membrane liner, said resealing means including interlocking tab and groove elements attached to the first and second upright sections.

2. A carton according to claim 1, wherein the body portion has a generally parallelepiped configuration and the boundary wall includes front, rear and side wall sections, the cover includes front, rear and side closure flaps formed in the top end of the boundary wall by embossed score lines, and the membrane liner is attached to the closure flaps.

3. A carton according to claim 2, wherein the upright sections and the carton opening have approximately equal lengths.

4. A carton according to claim 3, wherein the upright sections are centrally positioned relative to the carton opening, and the membrane opening approximately corresponds to the dimensions of the carton opening.

5. A carton having a parallelepiped configuration which comprises: an open ended body portion including front, rear and side wall sections, a top end peripheral edge which defines the carton opening; a cover for closing the top end of the carton, said cover including front, rear and side closure flaps which are attached to the top end peripheral edge at embossed score lines, said closure flaps having interior surfaces; and a membrane liner which overlies and seals the carton opening, said liner including first and second attachment sections which are secured to the interior surfaces of the closure flaps, and first and second upright sections which respectively extend outwardly from the first and second attachment sections and terminate at aligned edges, said upright sections being secured together at the terminal edges by a removable connecting membrane strip, said terminal edges, when the strip is removed, defining a membrane opening which communicates with the carton opening, the membrane and carton opening having approximately equal lengths, said upright sections also including integral interlocking tab and groove elements for resealing the membrane liner.

6. A carton according to claim 5, wherein the upright sections are integral parts of the respective attachment sections, and the upright sections include a tear line which facilitates separation of the removable connecting membrane strip.

* * * * *